US007828173B2

(12) United States Patent
Geier et al.

(10) Patent No.: US 7,828,173 B2
(45) Date of Patent: Nov. 9, 2010

(54) ASSEMBLY CONSISTING OF A DISPENSING VALVE AND A POUCH IN FLUID-TIGHT CONNECTION THEREWITH

(75) Inventors: Adalberto Geier, Trento (IT); Giuseppe Dalsant, Baselga di Pine (IT)

(73) Assignee: Coster Tecnologie Speciali S.p.A., I-Calcerarica al Lago (Trento) (IT)

( * ) Notice: Subject to any disclaimer, the term of this patent is extended or adjusted under 35 U.S.C. 154(b) by 1099 days.

(21) Appl. No.: 10/554,689

(22) PCT Filed: Apr. 21, 2004

(86) PCT No.: PCT/EP2004/004231

§ 371 (c)(1),
(2), (4) Date: Sep. 6, 2006

(87) PCT Pub. No.: WO2004/096665

PCT Pub. Date: Nov. 11, 2004

(65) Prior Publication Data

US 2007/0119874 A1 May 31, 2007

(30) Foreign Application Priority Data

Apr. 28, 2003 (EP) ..... 03009538

(51) Int. Cl.
*B67D 7/60* (2010.01)
*B65D 35/28* (2006.01)

(52) U.S. Cl. ..... 222/105; 222/386.5; 222/402.1; 222/402.24; 141/3; 141/20

(58) Field of Classification Search ..... 222/105, 222/107, 94, 402.1, 183, 402.24, 386.5, 389, 222/402.16, 402.19, 402.18, 95; 141/3, 20
See application file for complete search history.

(56) References Cited

U.S. PATENT DOCUMENTS 4,340,155 A * 7/1982 Obrist ..... 222/135
5,630,530 A * 5/1997 Geier et al. ..... 222/95

(Continued)

FOREIGN PATENT DOCUMENTS

DE 23 37 235 A 2/1974

(Continued)

*Primary Examiner*—Kevin P Shaver
*Assistant Examiner*—Stephanie E Williams
(74) *Attorney, Agent, or Firm*—Knobbe Martens Olson & Bear LLP

(57) ABSTRACT

Assembly (10) consisting of a dispensing valve (11) for dispensing pressurized fluids, and a pouch (12) of flexible film material in fluid-tight connection therewith, which is placeable in an outer container (15) through an opening (14) therein that is sealable by a cover (13), the dispensing valve (11) having a valve body (18) which is mountable fluid-tightly at the edge (16) of a cover opening (17) formed in the container cover (13), to which valve body (18) an outlet tube (20) extending through a pouch opening (19) is able to make fluid-tight connection. The outlet tube (20) has a disc-shaped, especially cylindrical-cap-shaped, widened portion (21) extending around the pouch opening (19) inside the pouch (12). The pouch (12) is supported against the widened portion (21) of the outlet tube (20), with the intermediate arrangement of an annular disc (22) that bounds the pouch opening (19).

7 Claims, 3 Drawing Sheets

U.S. PATENT DOCUMENTS

| | | | | |
|---|---|---|---|---|
| 6,012,924 | A * | 1/2000 | Reynaud et al. | 433/220 |
| 6,401,979 | B1 * | 6/2002 | Mekata et al. | 222/105 |
| 2003/0102328 | A1 * | 6/2003 | Abplanalp et al. | 222/105 |
| 2005/0077319 | A1 * | 4/2005 | Binois et al. | 222/105 |

FOREIGN PATENT DOCUMENTS

| | | | |
|---|---|---|---|
| DE | 27 04 013 | A | 8/1978 |
| EP | 0 389 191 | A1 | 3/1990 |
| EP | 0 471 503 | A | 2/1992 |
| EP | 0521278 | A1 * | 1/1993 |
| EP | 0 697 348 | A | 2/1996 |
| WO | WO 96/26868 | | 9/1996 |

* cited by examiner

ASSEMBLY CONSISTING OF A DISPENSING VALVE AND A POUCH IN FLUID-TIGHT CONNECTION THEREWITH

The present invention relates to an assembly, consisting of a dispensing valve for dispensing pressurised fluids, foams, gels or the like and a pouch of flexible film material in fluid-tight connection therewith, in accordance with the preamble of claim 1.

Such an assembly is known from the Applicant's specification EP 0 697 348 B1. That specification also discloses, in particular, a preferred construction of the dispensing valve in which a dispensing tube is mounted in the valve body so as to be axially displaceable, more specifically from a closed position into a fluid-dispensing position, against the action of a resilient element, especially a helical compression spring. Between the edge of the cover opening and the valve body, the dispensing tube is closely surrounded by a ring seal of rubber or like resilient sealing material in such a way that when the dispensing tube or dispensing valve is in the closed position, the ring seal closes off the passage to an outlet channel formed in the dispensing tube. Inside the pouch there is arranged an outlet tube which, passing through the film of the pouch and with the intermediate arrangement of a sealing ring, is connectible to the valve body of the dispensing valve in such a way that a connection for fluid is obtained between the interior of the pouch and the valve body of the dispensing valve. The outlet tube and/or the valve body consist of a material that is break-resistant and, in particular, impermeable to organic media. The outlet tube has a disc-shaped widened portion, especially in the shape of a cylindrical cap, extending around the said pouch opening inside the pouch. As a result, the film of the pouch is kept away from the inner portion of the outlet tube. This is important both for filling the pouch and for dispensing fluid from the pouch.

Drop tests with filled pouches have shown that when the pouch is welded directly to the outlet tube, or to the widened portion thereof, the pouch can tear around the pouch opening. In order to avoid this, the film of the pouch has hitherto also been welded to the periphery of the cylindrical-cap-shaped widened portion. Such a procedure is relatively complex and, furthermore, is likewise not 100% tear-resistant.

The present invention is therefore based on the problem of eliminating the afore-mentioned weak point in the pouch film and the connection thereof to the outlet tube and the valve body.

That problem is solved according to the invention by the characterizing features of claim 1, preferred structural details being described in the subsidiary claims.

The core of the present invention therefore lies in additionally reinforcing the peripheral edge of the pouch opening through which the outlet tube passes before it enters into fluid-tight interlocking engagement with the valve body. Preferably, the pouch, with the intermediate arrangement of an annular disc that bounds the pouch opening, is supported against the widened portion of the outlet tube.

In this special construction, the pouch opening is therefore stabilised by an annular disc which is preferably welded to the pouch film on the inner side of the pouch. Accordingly, in this construction the annular disc also consists of a material that is readily weldable to the pouch film, for example polyethylene, polypropylene, polyamide or the like. By virtue of the pouch opening through which the outlet tube extends from the interior of the pouch to the outside being stabilized in accordance with the invention, the afore-mentioned tears no longer occur in drop tests.

Preferably, the pouch film, together with the previously welded-on annular disc, is placed onto the outlet tube before the pouch film is welded at the edges to form a fluid-tight pouch. It would also be possible for the annular disc to be welded or adhesively bonded to the widened portion of the outlet tube arranged inside the pouch. Independently of the possible assembly methods mentioned above, the annular disc bounding the pouch opening stabilises the passageway for the outlet tube out of the pouch so that, in drop tests, tears no longer occur at that point. It should also be mentioned at this point that the welding of the pouch film to the widened portion in the prior art also created relatively high stresses in the film after the pouch had been filled, which were then released in drop tests and resulted in the mentioned tears.

As in the prior art, the portion of the outlet tube that extends through the pouch opening can preferably be locked in place in a corresponding opening in the valve body, especially the base thereof, in such a way that the valve body is fluid-connectible to the interior of the pouch fluid-tightly with respect to the interior of the outer container.

Furthermore, as also in the prior art, the valve body of the dispensing valve as well as the outlet tube, including the widened portion, preferably consist of polyacetal, which is very resistant to breakage.

A preferred embodiment of an assembly according to the invention is described in detail below with reference to the accompanying drawings, wherein FIG. 1 is a side view of an assembly located in a container, the container being shown in longitudinal section;

Figure 1:
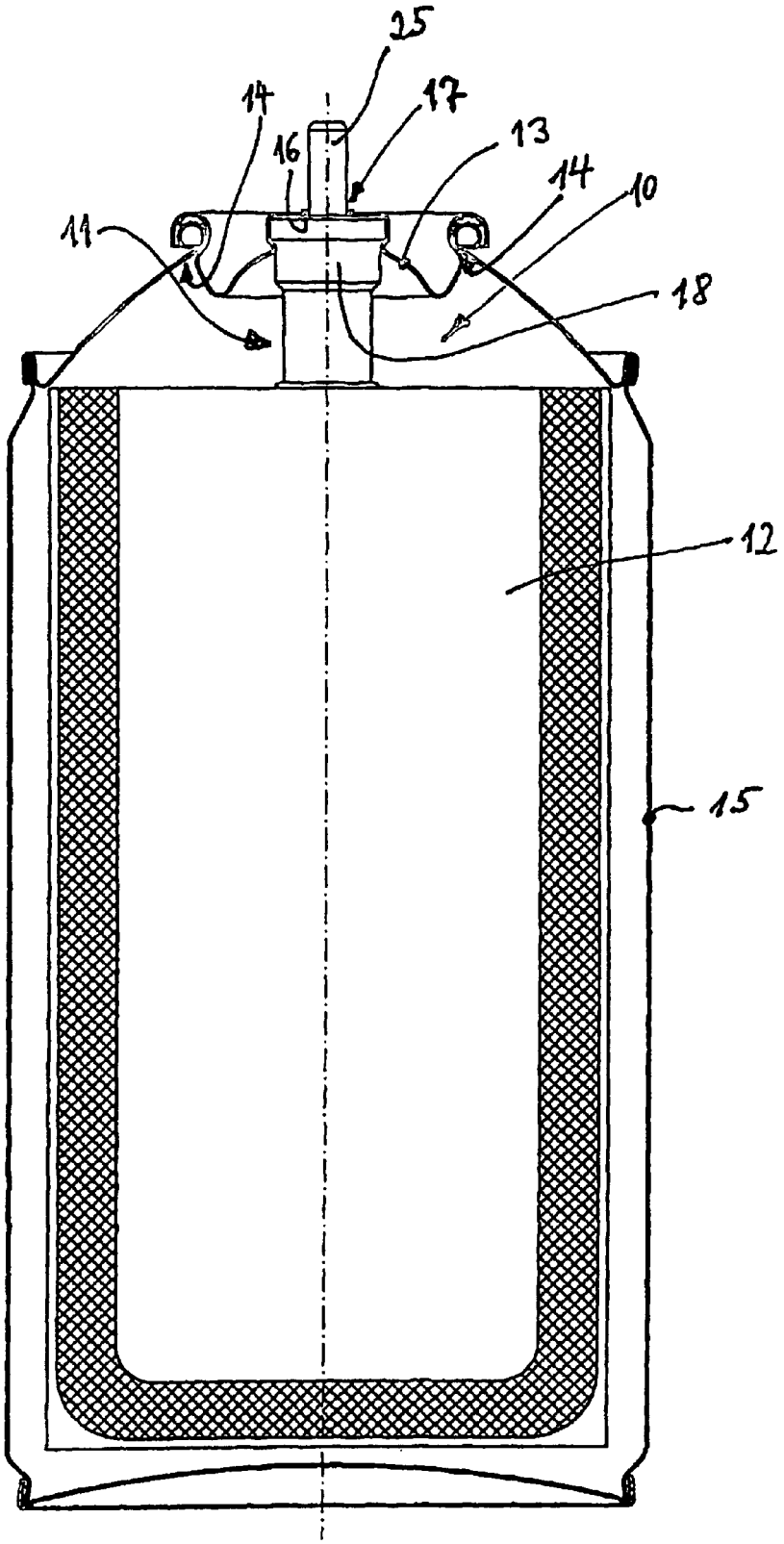
Figure 2:
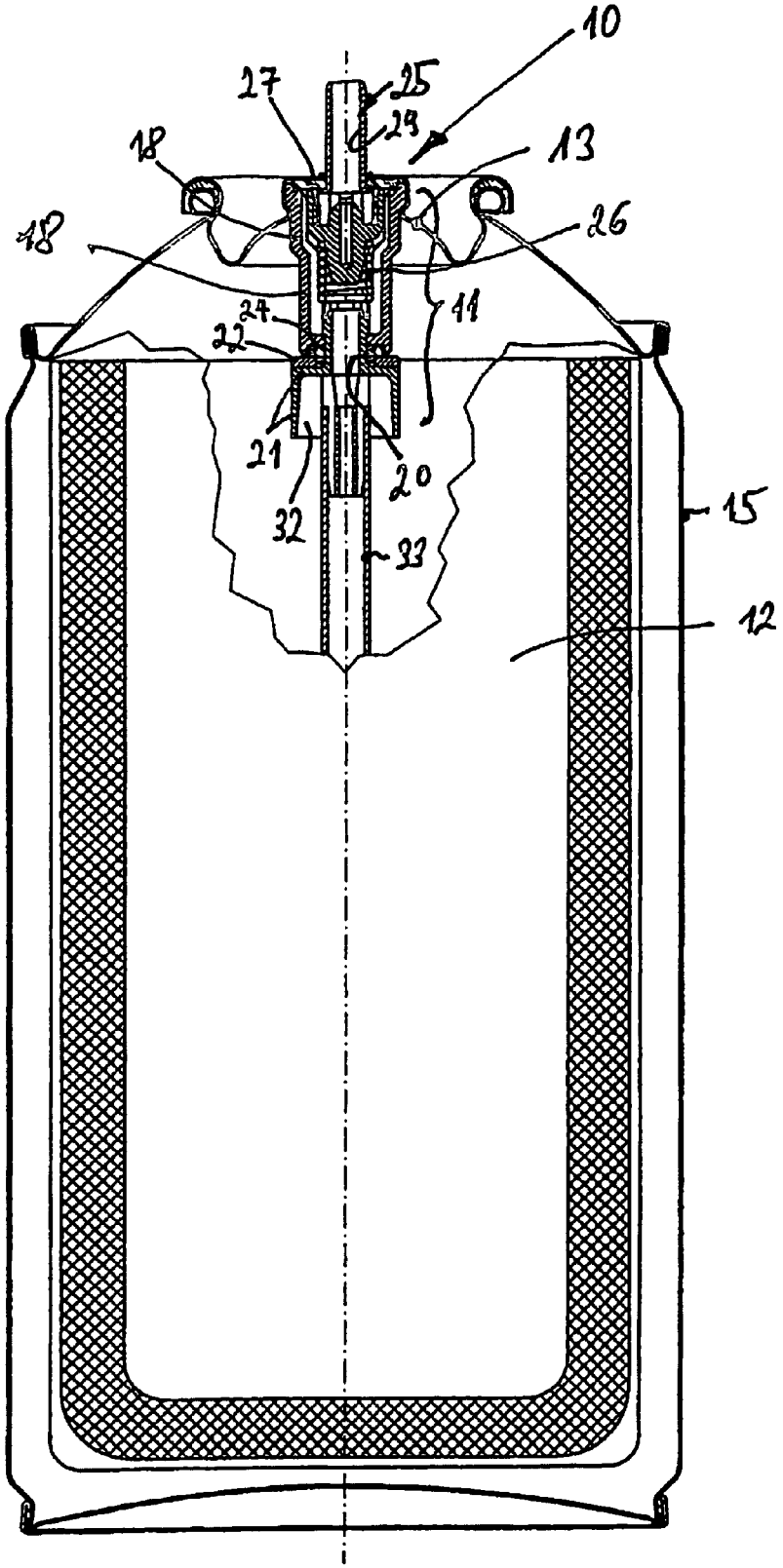
FIG. 2 is a view corresponding to FIG. 1, wherein the pouch arranged inside the container is shown partly broken away in the region of the dispensing valve and the dispensing valve is shown in section.

FIGS. 1 to 4 show an assembly 10 consisting of a dispensing valve 11 and a pouch 12 in fluid-tight connection therewith. An outer container 15, which may consist, for example, of tin plate or plastics material, surrounds the pouch 12 so that a receiving chamber is defined between those two components. The container 15 has at its upper end an opening 14 through which the pouch 12 is inserted into the container 15 and through which, in the inserted state, the dispensing valve 11 projects beyond the container 15. The opening 14 is closed by means of a cover 13 in the customary way. A cover opening 17 is in turn formed in the cover 13. A valve body 18 of the dispensing valve 11 is held in that cover opening 17, by means of the edge 16 thereof, in such a way that a dispensing tube 25 associated with the dispensing valve 11 extends through the cover opening 17. The dispensing tube 25 can accordingly be actuated from the outside.

Pouch 12 and container 15 therefore constitute a two-chamber packaging, the pouch 12 (in the present embodiment) being filled or fillable with a fluid or paste-form filling and the container 15 being filled or fillable with a pressure medium, such as, for example, air or butane.

In the first instance—as explained in greater detail hereinbelow—the above-mentioned contents of the pouch and container can be introduced into the pouch and container, respectively, by way of the dispensing valve 11, the pouch 12 expanding in the container 15 and occupying a substantial portion of the container volume. When the pouch is emptied, the pouch contents can be expelled by way of the dispensing valve 11, more specifically through the dispensing tube 25, the pressure medium in the container 15 expanding accordingly.

The pouch 12 consists of a flexible film material composed of a plurality of layers. In the present case, the film comprises three layers, namely an outer polyamide or polyester layer, a middle aluminium layer and an inner polyethylene or polypropylene layer.

The pouch 12 extends substantially over the entire length of the interior of the container 15. Specifically, it is formed by a film of the above-mentioned kind that is folded over and welded or sealed along the edges.

As explained in greater detail below, the pouch 12 is maintained fluid-tight on a portion of the dispensing valve 11.

The valve body 18 accommodates the dispensing tube 25 which is mounted so as to be displaceable axially from a closed position to an open position and vice versa, the dispensing tube 25 being movable out of a closed position against the action of a helical compression spring 26. The helical compression spring 26 is supported at one end on a seat in the lower region of the valve body 18 and at the other end on the dispensing tube 25 itself.

Between the edge 16 of the cover opening 17 and the valve body 18 there is provided a ring seal 27, for example of rubber, which also fluid-tightly surrounds the dispensing tube 25. The ring seal 27 closes off the top of the cylindrical valve body 18, which is open at the top. It therefore has a double function. Firstly, it prevents material from unintentionally escaping from the pouch by way of the interior of the valve body; secondly, medium from the interior of the container cannot unintentionally pass into the outer environment. By actuation of the dispensing tube 25 in a direction opposite to the action of the helical compression spring 26, a passage 28—as will be seen especially in FIG. 4—is opened, an upper peripheral edge of the valve body 18 being lifted away from the ring seal 27 on the inside. In that case, a connection for fluid is created between the outlet channel 29 in the dispensing tube 25 and the interior of the valve body, which—as will be explained hereinbelow—is in turn in fluid-connection with the interior of the pouch. Reference is made in this respect to the corresponding fluid arrow 30 in FIG. 4.

The valve body 18 has, at its lower (as shown in the Figures) end, a bore 31 which defines a passage to the inner cavity of the valve body 18. Through this bore 31 there can be introduced a length or portion of an outlet tube 20 which locks in place in the fully inserted state. The locking action is achieved as a result of a radially outwardly projecting annular flange formed on the dispensing-valve-side end of the mentioned length of tube, the flange entering into locking engagement behind the bore 31 inside the valve body 18 in the mounted state.

The length of tube 20 is inserted through an opening in the pouch film prior to being introduced into the bore 31 of the valve body 18, so that the pouch 12, with the intermediate arrangement of a further sealing ring 24, is clamped between the outlet tube 20 and the valve body 18. By virtue of the intermediately arranged sealing ring 24, complete sealing with respect to the interior of the container is achieved.

The outlet tube 20, which is located in the interior of the pouch, comprises, immediately adjoining the pouch 12, a cylindrical-cap-like widened portion 21 which defines an annular-disc-shaped support surface for the pouch film clamped between the outlet tube 20 and valve body 18. In order substantially to reduce the risk of the pouch being torn at this point, the pouch opening 19 is bounded, and accordingly stabilised, on the inside, that is to say inside the pouch 12, by an annular disc 22. The annular disc 22 bounding the pouch opening 19 consists of a material that is readily weldable to the pouch film and is accordingly welded thereto around the pouch opening 19. The annular disc 22 preferably consists of polyethylene, polypropylene, polyamide or like material.

The valve body 18, or the base thereof that faces the pouch 12, is therefore supported, with the intermediate arrangement of the annular disc 22 bounding the the pouch opening 19, against the cylindrical-cap-like widened portion 21 of the outlet tube 20, the fluid-tight sealing between the interior of the pouch and the interior of the valve body 18 being ensured by the afore-mentioned sealing ring 24. The interlocking engagement between the outlet tube 20 and the valve body 18 inside the bore 31 is effected under axial bias, which is lastingly ensured by the sealing ring 24, which is made of rubber or like material.

Figure 4:
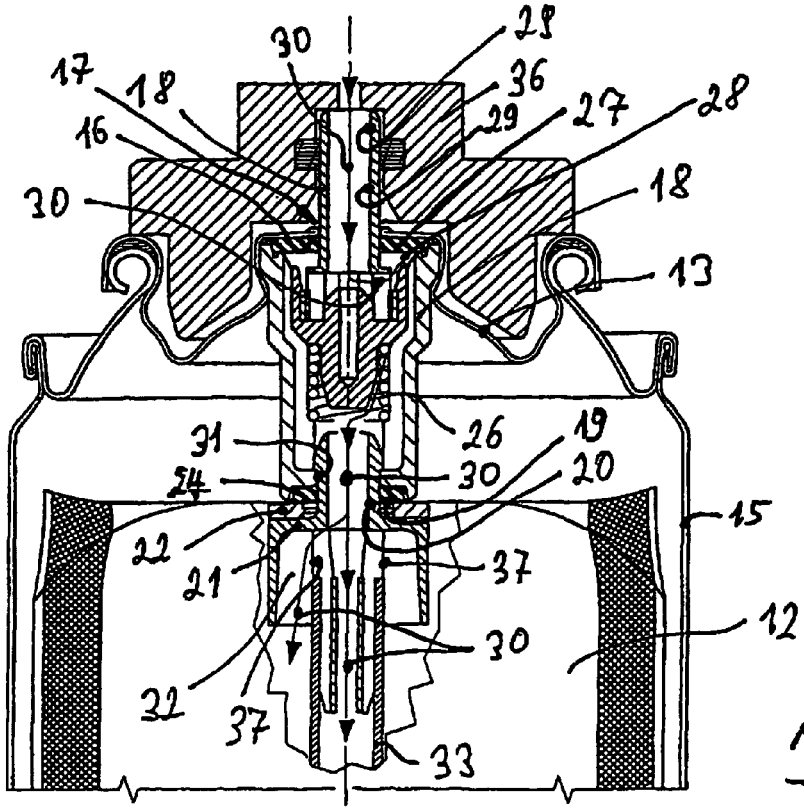
FIG. 4 is an enlarged diagrammatic view of a detail in section similar to FIG. 3, wherein the outlet tube in the interior of the pouch is also shown in section, and a filling device for filling the pouch is arranged on the dispensing valve.

Between the cylindrical-cap-like widened portion 21 and the outlet tube 20 that continues into the pouch 12, there is defined an annular space 32 which is open towards the interior of the pouch (towards the bottom in FIG. 4).

As already described above, the dispensing valve 11, namely the valve body 18, the dispensing tube 25 and the outlet tube 20, are made of a material that is both break-resistant and impermeable to organic media. Polyacetal, for example, is suitable for that purpose.

On the other hand, the sealing ring 24 consists of a material that is readily weldable to the pouch material, for example of polyethylene, polypropylene or the like.

Overall, the described construction ensures high resistance to breakage. Furthermore, an exchange of media between container and pouch is prevented. In addition, long-lasting sealing of the pouch at the dispensing valve 11 and, accordingly, a correspondingly long-lasting connection between the pouch and the dispensing valve can be achieved. Finally, the sealing ring 24 also ensures that the pouch opening 19 does not tear, even under relatively high stress (drop test) and even when the pouch has not been additionally welded around the outer periphery of the cylindrical-cap-like widened portion 21. Such additional welding is unnecessary in accordance with the invention, with the result that it is also unnecessary to provide a suitable coating on the outer periphery of the cylindrical-cap-like widened portion 21 in order to obtain a good welded connection between the widened portion 21 and the pouch film.

The lower end of the outlet tube 20 is adjoined by a vertical pipe 33 which extends to a point close to the base of the pouch 12. That vertical pipe 33 also acts to stabilise the pouch 12, especially when the pouch 12 is being introduced into the container 15.

A brief explanation of how the intermediate chamber between the pouch 12 and the container 15 or the interior of the pouch 12 can be filled will be given below.

Figure 3:
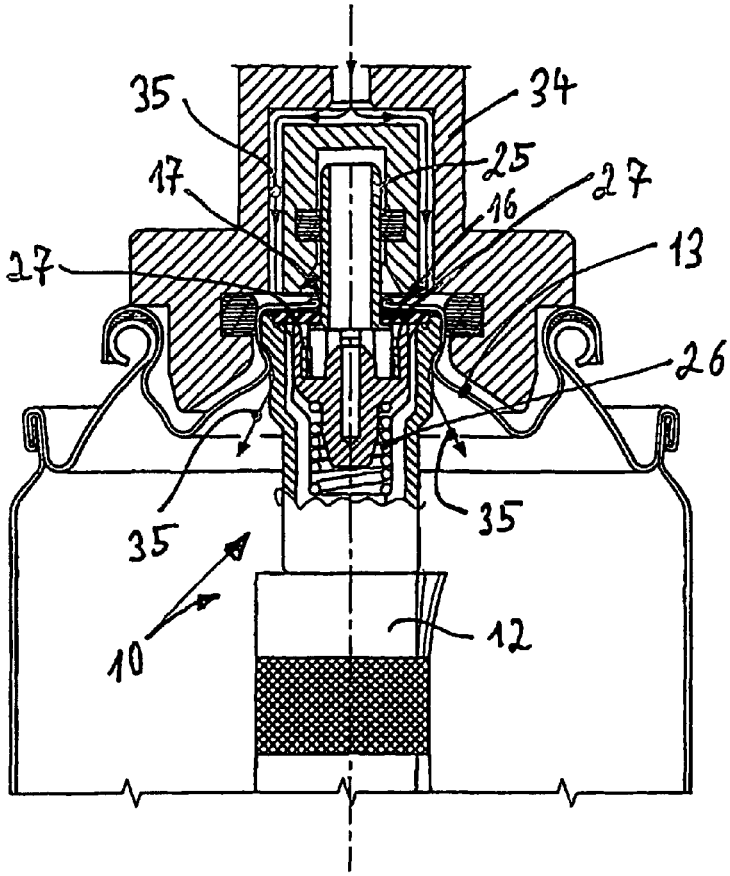
FIG. 3 is an enlarged diagrammatic view of a detail in section, wherein inter alia the valve body is shown enlarged and in section, and a filling cap for filling the interior of the container is positioned on the dispensing valve.

According to FIG. 3, a filling cap 34 suitable for filling the container 12 is placed onto the dispensing valve 11 or onto the upper end of the container 15, sealing being effected in the form of O-ring seals between the filling cap 34 and the cover 13 on the one hand and the filling cap 34 and the dispensing tube 25 on the other. A flow path is so formed inside the filling cap 34 that a medium can be introduced into the region in which the dispensing tube 25 projects out of the cover opening 17. If a medium is then supplied under pressure by way of the flow paths formed in the filling cap 34, the ring seal 27, as shown in FIG. 3, is pressed downwards or is pressed away from the cover edge 16 into the interior of the container, so that a flow path is formed between the ring seal 27 and the cover 13 and subsequently between the valve body 18 and cover 13. By means of that flow path, a connection for fluid is defined between the filling cap 34 and the interior of the container, so that the medium supplied by way of the filling cap 34 can be introduced into the container 15. In the present case, a propellant or gas is introduced into the interior of the container, there preferably being used air, butane or some other environmentally friendly propellant. The afore-mentioned flow path is indicated by reference numeral 35 in FIG. 3.

For filling the pouch 12, a filling cap 36 shown in FIG. 4 is used, which has an O-ring seal for providing a seal between the dispensing tube 25 and the filling cap 36. When the filling cap 36 is being put on, the dispensing tube 29 is moved in the direction opposite to the compression spring 26 out of its closed position and into an open position. In this position the outlet channel 29 is in fluid-connection with the interior of the valve body 18, which in turn, by way of the outlet tube 20, discharges into the interior of the pouch 12. The discharge is effected on the one hand at the lower end of the vertical pipe 33, that is to say in the lower region of pouch 12, and on the other hand at lateral openings 37 of the outlet tube 20 in the region of the annular chamber 32 in the upper portion of the pouch 12.

If the intermediate chamber between the pouch 12 and the container is then filled with butane or if a gel containing isopentane, for example, is introduced into the pouch, no exchange of organic media takes place in the afore-mentioned described assembly. It is therefore not possible either for equalisation of pressure to take place, which would result in the entire device's becoming inoperative.

When the pouch is being emptied, the dispensing tube 25 is pressed downwards against the action of the helical compression spring 26, so that the pouch contents are expelled, the pressurised gas in the container 15 expanding.

With this assembly there is created a device which is resistant to breakage and to tearing, both in respect of the dispensing valve and in respect of the pouch.

In a simplified embodiment, the cylindrical-cap-like widened portion 21 is replaced by a simple disc which extends transversely to the outlet tube 20 and forming an annular-disc-shaped support surface for the pouch or for the annular disc 22 welded to the pouch.

All the features disclosed in the application documents are claimed as being important to the invention, provided they are novel over the prior art either singly or in combination.

REFERENCE NUMERALS

10 assembly
11 dispensing valve
12 pouch
13 cover
14 opening
15 outer container
16 peripheral edge of the cover opening
17 cover opening
18 valve body
19 pouch opening
20 outlet tube
21 widened portion (disc-shaped or cylindrical-cap-shaped)
22 annular disc
24 sealing ring
25 dispensing tube
26 helical compression spring
27 ring seal
28 passage
29 outlet channel
30 fluid arrow
31 bore
32 annular space
33 vertical pipe
34 filling cap
35 flow path
36 filling cap
37 lateral opening

The invention claimed is:

1. A dispensing assembly comprising:

a dispensing valve and a pouch of flexible film material in fluid-tight connection with said dispensing valve, said pouch being adapted to be placed in an outer container through an opening therein that is sealable by a cover, said dispensing valve having a valve body operative to be mounted fluid-tightly at the edge of a cover opening formed in said container cover, to which valve body an outlet tube extending through an opening in said pouch is adapted to make fluid-tight connection, said pouch opening comprising a circumferential rim, said outlet tube having a widened portion selected from the group consisting of a disc-shaped widened portion, and a disc-shaped widened portion of cylindrical-cap shape extending around said pouch opening inside the pouch, wherein the circumferential rim of said pouch opening through which said outlet tube extends is reinforced by an annular disc around said pouch opening, wherein said annular disc around said pouch opening is welded to the pouch film around said pouch opening and is positioned between the valve body and the widened portion of the outlet tube.

2. An assembly according to claim 1, wherein the internal diameter of said annular disc bounding the pouch opening is greater than the outer diameter of the portion of said outlet tube extending to the outside through said pouch opening.

3. An assembly according to claim 1, wherein said annular disc bounding the pouch opening is welded to said pouch on the inner side thereof.

4. An assembly according to claim 1, wherein said annular disc bounding the pouch opening is welded to said disc-like widened portion of the outlet tube.

5. An assembly according to claim 1, wherein the portion of the outlet tube that extends through said pouch opening is operative to be so locked in place in a corresponding bore of said valve body that said valve body is fluid-connectible to the interior of the pouch fluid-tightly with respect to the interior of the outer container.

6. An assembly according to claim 1, wherein a sealing ring extending around said outlet tube is arranged between said valve body and said pouch.

7. An assembly according to claim 1, wherein the valve body of said dispensing valve and said outlet tube, including said widened portion, consist of polyacetal, and said reinforcement means readily weldable to the pouch film is made from material selected from the group consisting of polyethylene, polypropylene, and like material.

* * * * *